United States Patent [19]

Dewell

[11] 4,067,391

[45] Jan. 10, 1978

[54] IN-SITU EXTRACTION OF ASPHALTIC SANDS BY COUNTER-CURRENT HYDROCARBON VAPORS

[76] Inventor: Robert R. Dewell, 1517 Nancy Lane, Liberty, Mo. 64068

[21] Appl. No.: 697,330

[22] Filed: June 18, 1976

[51] Int. Cl.[2] ..... E21B 43/24

[52] U.S. Cl. ..... 166/303; 166/50; 166/267; 166/306

[58] Field of Search ..... 166/250, 266, 267, 268, 166/272, 303, 306, 50

[56] References Cited

U.S. PATENT DOCUMENTS

| | | | |
|---|---|---|---|
| 1,520,737 | 12/1924 | Wright | 166/50 X |
| 1,816,260 | 7/1931 | Lee | 166/303 |
| 2,412,765 | 12/1946 | Buddrus et al. | 166/272 X |
| 2,857,002 | 10/1958 | Pevere et al. | 166/303 |
| 3,040,809 | 6/1962 | Pelzer | 166/272 X |
| 3,386,508 | 6/1968 | Bielstein | 166/303 X |
| 3,608,638 | 9/1971 | Terwilliger | 166/272 |
| 3,838,738 | 10/1974 | Redford et al. | 166/272 X |
| 3,945,435 | 3/1976 | Barry | 166/267 |
| 4,020,901 | 5/1977 | Pisio et al. | 166/50 |

FOREIGN PATENT DOCUMENTS

| | | | |
|---|---|---|---|
| 782,369 | 4/1968 | Canada | 166/303 |

*Primary Examiner*—Stephen J. Novosad
*Assistant Examiner*—George A. Suchfield
*Attorney, Agent, or Firm*—Lowe, Kokjer, Kircher, Wharton & Bowman

[57] ABSTRACT

A method of extracting highly viscous nonfracturable oil from earthen deposits is presented by the instant invention. A plurality of radially extending horizontal conduits direct heated hydrocarbon vapors into the formation. The vapors are selected to have a boiling point above the pour point of the viscous oil. Thus, as the vapors rise in the formation, they will be in heat exchange relationship with the viscous oil to cause the latter to flow downwardly. In addition to the thermal exchange of energy, the vapors will move toward molecular equilibrium with the viscous oil formation. This latter action will cause the vapors to "strip off" the more volatile, lower boiling components, from the descending liquid oil. The liquified oil, on the other hand, will condense the less volatile, higher boiling point fraction of the vapors. The total effect is one of rectification which establishes a distinct temperature gradient in the formation and results in complete dissemination of the vapors from the bottom to the top. Because the temperature is maximized at the point of withdrawal of the liquified oil, removal of the oil is facilitated. To this end, a plurality of second conduits, radially extending and horizontally disposed, are placed in the formation to carry off the liquified oil. By allowing the liquified oil to accumulate to a degree at the bottom of the formation and locating the openings for extracting the liquid below the vapor outlet openings, a pool is formed which seals off the vapor from extraction openings, thereby preventing the vapors from returning until condensed as liquid.

9 Claims, 3 Drawing Figures

IN-SITU EXTRACTION OF ASPHALTIC SANDS BY COUNTER-CURRENT HYDROCARBON VAPORS

This invention relates to the recovery of oil from earthen deposits and, more particularly, to a method of extracting highly viscous non-fracturable oil formations.

Naturally occurring asphalts are present in widespread deposits throughout the world. The deposits commonly occur near the surface with overburdens ranging from a few feet to one thousand, or more, feet. While some deposits are in consolidated rocks, vast quantities are associated with free sand or gravel. In these deposits of asphalt and sand the particles commonly range in size from 40 to 100 (USA Standard Testing Sieve) mesh and the asphalt content ranges from 10 to 20 percent. The quantity of asphalt resident in such deposits is immense. Even minor deposits in the American west may contain 20 or more millions of barrels of oil (or asphalt) per square mile. The vast McMurray sands of western Canada are said to contain 100 to 300 billion barrels of such asphalt.

These deposits are not capable of being produced by conventional drilling methods because the oil is too viscous to flow to drilled holes while in its native state and because an active gas pressure is not present. Also, the oil in its viscous condition will carry the associated sand into a conventional well bore, with resultant pluggage.

Various methods of mining and ex-situ processing of deposits of highly viscous oil-sand mixtures have been proposed or actually carried out. For any type of ex situ processing, even where surface deposits are present, the practical difficulties of handling and disposing of the vast quantities of associated sand are immense.

One form of in situ processing is shown in U.S. Pat. No. 3,386,508. The process disclosed in this patent employs heating of viscous oil sands and draining of the oil contained therein to a central shaft, or to some part of the casing by means of which the heated media was introduced. In another prior art process, disclosed in U.S. Pat. No. 2,412,765, condensed hydrocarbon vapors are utilized to lower the viscosity and surface tension of oil in partially depleted reservoirs. The process disclosed in the patent is intended to proceed generally from top to bottom of the deposit which is not an efficient use of the extractant. Also, the process is dependent upon having a partially depleted reservoir and requires the presence of a largely impermeable reservoir cap. One prior art patent which has employed vapor extraction of oil is U.S. Pat. No. 3,358,756. The process disclosed in this patent is, however, limited to fracturable formations which many viscous oil deposits are not. Also, the fracturing process is more expensive and less efficient that the process of the present invention.

It is, therefore a primary object of the present invention to provide a method of recovering highly viscous non-fracturable oil from earthen deposits.

An important objective of the invention is to also eliminate the ecological problems associated with strip mining and other types of ex situ processing by conducting the extraction beneath the earthen surface.

Another important objective of the present invention is to provide a process for extraction of non-fracturable, highly viscous oil deposits through the use of counter-current vapor extraction whereby loss of the extraction media is minimized by virtue of a counter-current extraction process which returns the extractant media to its point of initial injection.

As a corollary to the foregoing objective, an aim of the invention is to provide an extraction process wherein the extractant moves from bottom to top of the formation, then back to the bottom, thereby decreasing the amount of extractant which is lost in the process.

It is also an important aim of this invention to provide for more efficient use of the extractant media in a vapor extraction process by utilizing hydrocarbons as the extractant, thereby avoiding the tendency of non-hydrocarbon fluids to bypass large amounts of oil by breaking through a deposit at the point of least resistance.

Still another object of the invention is to employ a hydrocarbon vapor in an extraction process which vapor will solubilize and dilute the oil deposit simultaneously as it heats the deposit to cause it to liquify, thereby resulting in more efficient extraction than is possible with non-hydrocarbon extractants.

Still another important object of this invention is to provide an extraction process for viscous, non-fracturable oil formations which process does not employ high differential pressures to drive the extractant and accordingly does not have as great an amount of extractant loss as is inherent in certain prior art techniques.

It is also an objective of this invention to provide a process for recovering non-fracturable, highly viscous, earthen oil deposits whereby a single pipe having concentric conduits therein may be used for introducing the extraction vapors and removing the liquified oil thereby reducing the cost of installing the recovery hardware.

Another object of the invention is to provide a method of recovering highly viscous non-fracturable earthen oil deposits which does not require the use of packers or other physical means of forcing the extraction media through the deposit and thereby is capable of being operated at lower cost.

One of the aims of this invention is to provide a method of extracting highly viscous, non-fracturable earthen oil deposits which utilizes a counter-current extraction process thereby assuring that the liquified oil nearest the point of recovery is at the highest temperature and lowest viscosity thereby enhancing the efficiency with which the oil is recovered and reducing the flow of sand into the recovery casing.

Other objects of the invention will be made clear or become apparent from the following description and claims, when read in light of the accompanying drawings, wherein:

Figure 1:
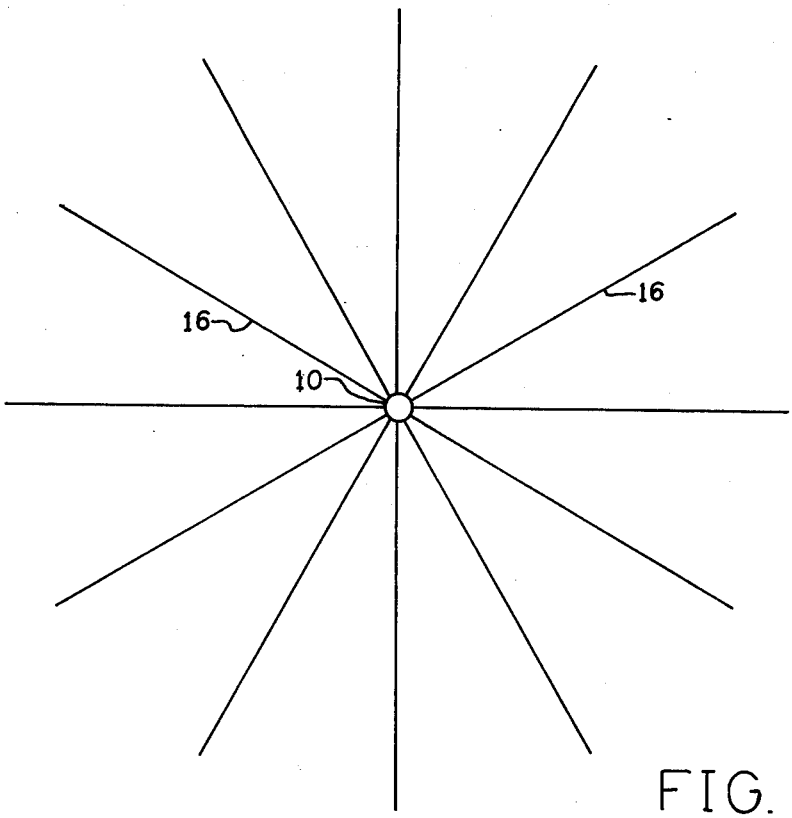
FIG. 1 is a schematic illustration, in plan view, of the casing arrangement for practicing the present invention.
Figure 2:
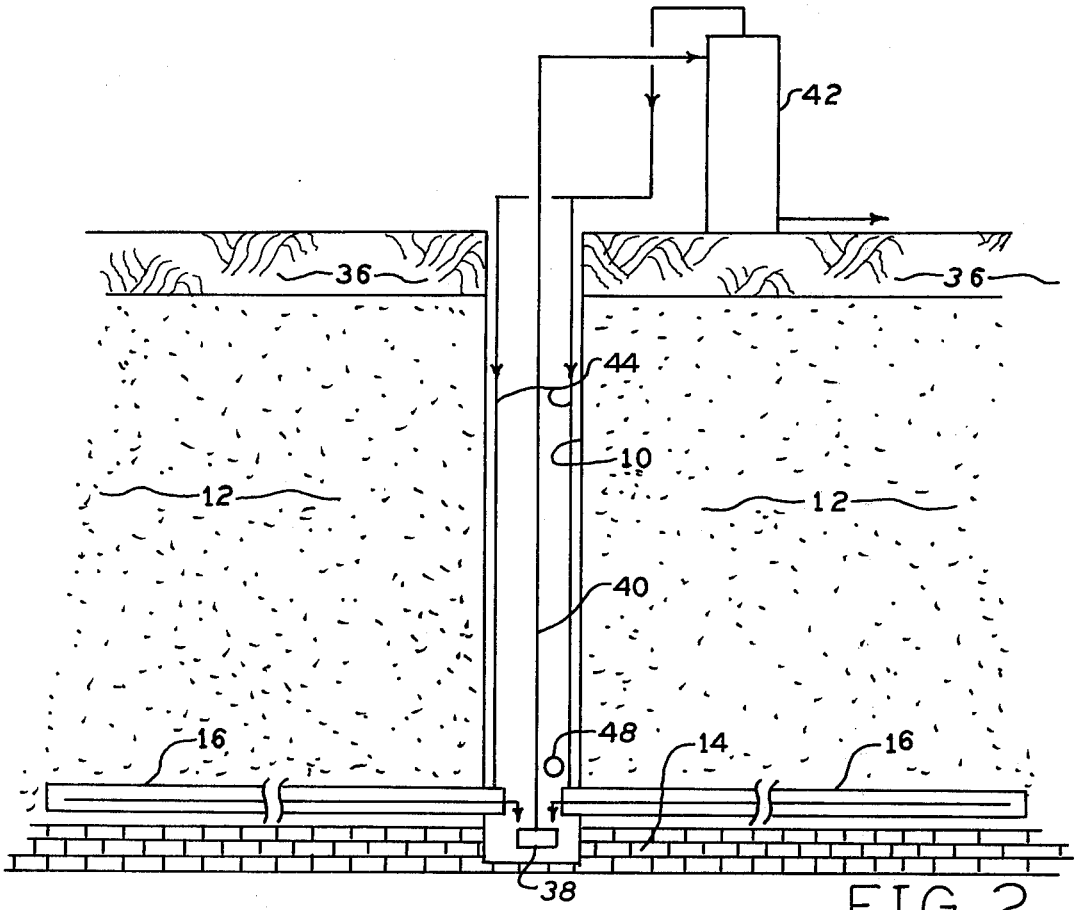
FIG. 2 is a partially schematic vertical cross-sectional view illustrating the manner in which the hardware is placed in the oil formation for carrying out the process of the present invention.

Referring initially to FIGS. 1 and 2, a central shaft 10 is sunk in an oil formation 12 down to the bed rock 14 which will normally lie beneath a formation of this type. Shaft 10 is, of course, lined with an appropriate casing as will be readily apparent to those skilled in the art.

Shaft 10 is preferably of a size to accommodate the operation of driving a plurality of generally horizontal pipes 16 outwardly from the shaft in a plurality of radial directions as best illustrated in FIG. 1. A shaft 10 of a minimum of about 6 feet in diameter is normally required. The horizontal pipes 16 may be driven into the formation by various means well known to those skilled in the art.

Figure 3:
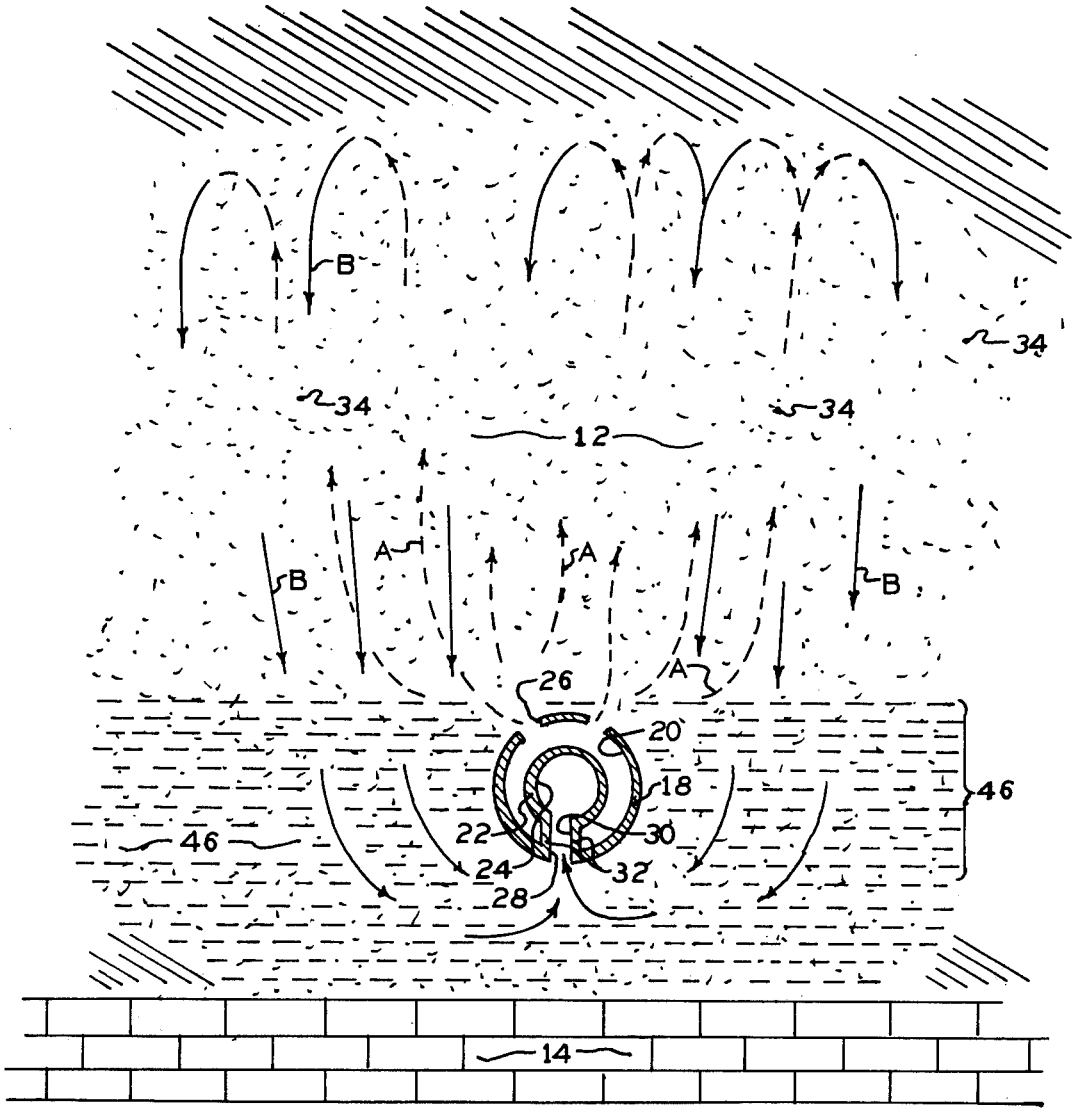
FIG. 3 is a greatly enlarged vertical cross-sectional view through the deposit illustrating the action of the extraction vapors and the manner in which the liquified oil is removed.

As illustrated in FIG. 3, each of the pipes 16 is preferably of a double walled construction, thus having an outer wall 18 forming a first conduit 20 and an inner wall 22 forming a second conduit 24. A plurality of slots or other openings 26 extend along the length of the pipe in outer wall 18 to communicate conduit 20 with the formation 12. A longitudinally extending slot or other opening 28 in outer wall 18 communicates with an opening 30 in inner wall 22, via a passageway presented by spaced apart transverse walls 32, to communicate conduit 24 with the formation 12.

It is to be understood that the typical deposit of highly viscous, unfracturable oil will contain a quantity of sand as described at the outset, and the sand particles are designated by the numerals 34 in FIG. 3. The formation 12 also typically will have an overburden of soil 36 as shown in the drawing.

Oil recovered from the extraction process is withdrawn by a pump 38 through a conduit 40 to a distillation plant 42 where relatively low boiling hydrocarbons are distilled and returned to the formation 12 via conduits 44 which are coupled with conduits 20 of each of the horizontal pipes 16.

The process of the present invention is particularly designed for use with highly viscous, unfracturable oil formations characterized by the oil being present in the formation at a temperature below its pour point; the oil representing the matrix phase of the formation and any sand present representing a discontinuous phase; an absence of horizontal layers of clay, shale, and other substances within the formation which would be impermeable to the flow of hydrocarbon vapors; and the residual sand resulting after dissolution of the oil phase being permeable to hydrocarbon vapors. Such deposits are normally found at depths of no greater than about 500 feet.

In the preferred form of the invention, naptha will be employed as the hydrocarbon extractant, although it is to be understood that other hydrocarbons having boiling points substantially within the range of approximately 100° F. to 400° F. can be utilized. This will include hydrocarbons having a molecular weight approximately within the range of 70 to 150 which will include the $C_5$ through $C_{11}$ hydrocarbons. Examples of suitable hydrocarbons which can be utilized in the process are: pentanes, hexanes, naphtha, toluene, gasoline, and light distillates. Petroleum naptha is a preferred extractant because of its availability.

The hydrocarbon vapors are introduced into the formation via conduits 20 and disseminate upwardly and outwardly as illustrated by broken line arrows A in FIG. 3. As the hydrocarbon vapors flow upwardly, they will heat the surrounding highly viscous oil to raise it above its pour point. As the oil becomes liquified above its pour point, it will flow downwardly and the extraction process will be enhanced by the intimate contact between the downwardly flowing liquid and the upwardly flowing vapors. The condensation of the vapors within the formation results in the transfer of the latent heat of vaporization to the viscous oil, thereby raising the temperature of the latter and lowering its viscosity and surface tension. The extractant vapor will also have a diluting and solubilizing effect on the downwardly flowing liquid as it comes into molecular equilibrium, as well as thermal equilibrium, with the counter flowing liquid. Thus, the rising hydrocarbon vapors will have a tendency to "strip off" the more volatile, lower boiling point components from the descending liquified oil. Similarly, the liquified oil will condense the less volatile or higher boiling point components from the vapor. This creates a rectification process and results in a temperature gradient being established in the formation. The lower temperature at the top of the formation will result in condensation of the heated vapors thereby causing a pressure differential which will cause other vapors to rise until they are condensed back to liquid. The downward path of the condensed liquid is indicated in arrows B in FIG. 3.

The absence of any fractures in the formation is of substantial benefit in not losing extractant and also in obtaining uniform distribution throughout the formation. Also, by relying exclusively on the inherent pressure differential between the top and bottom of the formation to drive the vapors, the extractant losses inherent in systems employing much higher pressure differentials are avoided.

As the liquified oil (from the formation as well as condensed extractant) accumulates at the bottom of the formation, a pool 46 will be formed which provides a liquid seal over the opening 28 through which the liquified oil is withdrawn via conduit 24. A liquid level control 48 (FIG. 1) is provided to control the action of pump 38 so that the height of pool 46 will be such that the pressure attributable to the accumulating liquid oil on opening 28 will prevent the egress of vapors emanating from openings 26 into the opening 28. Manifestly, the rate of extraction of the liquid oil should not be greater than a rate which will maintain the level of pool 46 at least covering opening 28. Manifestly, it is also necessary that the velocity of the effluent vapor emanating from openings 26 be sufficiently low so as not to exert a pressure greater than the static pressure which can be contained by the liquid seal. To accomplish the foregoing, pipes 16 will normally be disposed horizontally with openings 26 located above opening 28. While the double walled pipes 16 are preferred, it will be appreciated that two pipes disposed in the formation for carrying extractant vapors and recovered oil, respectively, could be utilized.

Since the temperature within the formation will be maximized at the area of pipes 16, the viscosity of the oil in pool 46 will be minimized thereby enhancing flowability of the liquid through conduit 24. The static pressure resulting from vapors emanating from openings 26 together with the static head resulting from oil pool 46 will force liquified oil through conduit 24 and into casing 10. Various devices apparent to those skilled in the art may be employed for pumping the liquified oil out of the casing through conduit 40 and maintaining the level of the liquid sufficient to seal opening 28. As the volume of the extracted portion of the oil increases, additional extractant vapor will be required to maintain the process. This may be provided from outside sources or, where the nature of the recovered oil permits, be provided by vaporization of the more volatile fraction of the recovered oil.

Having thus described the invention, I claim:

1. A method of extracting viscous oil from a non-fracturable earthen formation wherein the oil is present at a temperature below the pour point, said method comprising the steps of:

forming a first conduit in the vicinity of the bottom of said formation, said conduit extending generally transversely of the vertical plane of the formation and having an opening communicating with said formation;

communicating said conduit with a source of hydrocarbon vapors characterized by a boiling point above the pour point of the oil in said formation;

directing said vapors upwardly from said conduit and into said formation to thereby raise the temperature of the oil above its pour point causing the oil to flow downwardly in the direction of said first conduit and toward the bottom of the formation;

forming a second conduit in said formation in close proximity to said first conduit and extending generally transversely of the vertical plane of the formation for conveying the oil flowing toward the bottom away from the formation;

said second conduit having an opening communicating with said formation which opening is below the level of the opening in the first conduit; and moving liquified oil heated above its pour point through said second conduit to a distal location.

2. A method as set forth in claim 1, wherein said communicating step comprises communicating said conduit within a source of hydrocarbon vapors characterized by a boiling point within the range of approximately 100° F. to 400° F.

3. A method as set forth in claim 2, wherein said hydrocarbon vapors are characterized by a molecular weight within the range of about 70 to 150.

4. A method as set forth in claim 2, wherein said formation comprises an asphalt deposit at a depth of no more than about 500 feet below the level of the surface.

5. A method as set forth in claim 1, wherein said moving step comprises moving the liquified oil through the second conduit at a minimum rate sufficient to keep any pressure attributable to accumulating liquid oil on the opening in the first conduit below a value which would prevent egress of vapors through the opening and at a maximum rate sufficient to provide a reservoir of accumulated liquid oil covering the opening in the second conduit.

6. A method as set forth in claim 5, wherein said conduits are disposed one within the other.

7. A method as set forth in claim 1, wherein said forming steps comprise, respectively, forming a plurality of said first conduits and a plurality of said second conduits.

8. A method as set forth in claim 7, wherein is included the step of forming a central shaft from which each of said first and second conduits radiate outwardly.

9. A method as set forth in claim 8, wherein each of said conduits is characterized by a plurality of locations for communication with the formation along the length of the conduit, and each of said conduits is disposed in a substantially horizontal position.

* * * * *